United States Patent [19]

Okayama

[11] Patent Number: 4,507,600

[45] Date of Patent: Mar. 26, 1985

[54] TWO-TERMINAL CURRENT REGULATOR

[75] Inventor: Tsutomu Okayama, Katsuta, Japan

[73] Assignee: Hitachi, Ltd., Tokyo, Japan

[21] Appl. No.: 481,250

[22] Filed: Apr. 1, 1983

[30] Foreign Application Priority Data

Apr. 2, 1982 [JP] Japan ..... 57-55818

[51] Int. Cl.[3] ..... G05F 1/56

[52] U.S. Cl. ..... 323/281; 323/312

[58] Field of Search ..... 323/265, 273, 275, 277, 323/280, 281, 285, 312, 313, 315, 282

[56] References Cited

U.S. PATENT DOCUMENTS 3,899,692 8/1975 Caswell ..... 323/312

4,435,678 3/1984 Joseph et al. ..... 323/273

FOREIGN PATENT DOCUMENTS 152017 11/1981 Japan ..... 323/285

*Primary Examiner*—Peter S. Wong

*Assistant Examiner*—Judson H. Jones

*Attorney, Agent, or Firm*—Antonelli, Terry & Wands

[57] ABSTRACT

A two-terminal current regulator has a sensing resistor, a reference voltage generator, a current controller, an error amplifier for controlling the current controller such that a voltage drop across the sensing resistor is equalized to a reference voltage generated by the reference voltage generator, and a current distributor for distributing currents to the reference voltage generator, current controller and the error amplifier such that the currents are proportional to a current flowing through the sensing resistor. Thus, a high precision constant current characteristic is attained.

14 Claims, 6 Drawing Figures

TWO-TERMINAL CURRENT REGULATOR

BACKGROUND OF THE INVENTION

1. Field of the Invention

The present invention relates to a two-terminal current regulator, and more particularly to a two-terminal current regulator which exhibits a high precision constant current characteristic to a power supply voltage variation.

2. Description of the Prior Art

In the past, a two-terminal current regulator which utilizes a drain current versus drain-source voltage characteristic of a junction type field effect transistor has been used, but it has a problem in that a constant current characteristic of an output current to a power supply voltage variation is poor.

FIG. 1 shows a circuit diagram of a prior art two-terminal current regulator which uses the junction type filed effect transistor. It is utilized in a circuit, for example, disclosed in U.S. Pat. No. 4,071,823 to T. Okayama issued on Jan. 31, 1978. Numeral 7 denotes a junction type field effect transistor (FET) having a drain thereof connected to a positive output terinal of a D.C. power supply 6, a gate and a source thereof connected together, the source being connected through a load 5 to a negative output terminal of the D.C. power supply 6. FIG. 2 shows an example of a drain current $I_D$ versus drain-source voltage $V_{DS}$ characteristic of the junction type FET of FIG. 1, with a gate-source voltage $V_{GS}$ being a parameter. An ordinate represents the drain current and an abscissa represents the drain-source voltage. As seen from FIG. 2, in a saturation region, the drain current can be maintained relatively constant to the variation of the voltage applied across the drain and the source by keeping the gate-source voltage $V_{GS}$ at a constant level, for example, 0 volt. Accordingly, a constant current can be supplied to the load 5 of FIG. 1. The constant current charactristic of the current regulator which uses the FET is determined by a gradient of the drain current $I_D$ versus drain-source voltage $V_{DS}$ characteristic of the FET used, that is, $I_D/V_{DS}$ in FIG. 2, and the constant current characteristic is poor.

On the other hand, a prior art three-terminal current regulator exhibits a good constant current characteristic but has several problems.

FIG. 3 shows a diagram for explaining a principle of the prior art three-terminal current regulator. A load 5 is connected between a positive output terminal of an external non-stabilized D.C. power supply 6 and a terminal 8 of a three-terminal constant current circuit. A current controller 3 including a PNP transistor and a sensing resistor 4 are connected in series between the terminal 8 and a terminal 9. The terminal 9 is connected to a negative output terminal of the external power supply 6. One input terminal of an error amplifier 2 is connected to the sensing resistor 4 and the other input terminal is connected to an output terminal of a reference voltage generator 1, and an output terminal of the error amplifier 2 is connected to an input terminal of the current controller 3. A terminal 10 is connected to the positive output terminal of the D.C. power supply 6. The reference voltage generator 1 and the error amplifier 2 are powered from the D.C. power supply 6 through the terminals 10 and 9 of the three-terminal current regulator. The reference voltage generator 1 generates a constant voltage of a predetermined voltage level. The error amplifier 2 compares the reference voltage with a voltage developed across the sensing resistor 4 when a current flowing in the load 5 flows through the sensing resistor 4 and controls the current controller 3 such that a difference between those voltages is rendered zero in order to maintain the current in the load 5 at a constant level.

The three-terminal current regulator described above exhibits a good constant current characteristic but the currents flowing in the reference voltage generator 1 and the error amplifier 2 and hence a sum current thereof $I_{SUPPLY}$ are not regulated. Thus, if the external D.C. power $I_{SUPPLY}$ 6 varies, the current $I_{SUPPLY}$ also varies. It also varies with the variation of an ambient temperature. In addition, the load 5 must always be connected between to positive output terminal of the D.C. power supply 6 and the terminal 8 and hence the position of the load 5 is limited.

SUMMARY OF THE INVENTION

It is an object of the present invention to provide a two-terminal current regulator which exhibits a good constant current characteristic.

In accordance with one aspect of the present invention, a high precision constant current characteristic is attained by current distribution means which determines the currents flowing in reference voltage generating means, control means and circuit means which generates an error signal to control the control means such that a reference voltage generated by the reference voltage generating means and a voltage drop in detection means which generates a voltage representative of a current flowing in accordance with an output voltage of a D.C. power supply are equalized, in such a manner that those currents are proportional to the current flowing in the detection means.

DESCRIPTION OF THE PREFERRED EMBODIMENTS

Figure 1:
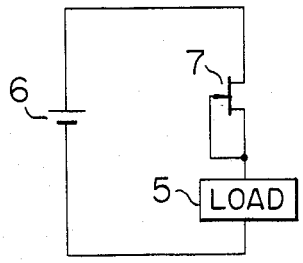
FIG. 1 is a circuit diagram for explaining a principle of operation of a prior art two-terminal current regulator having a junction type field effect transistor.
Figure 2:
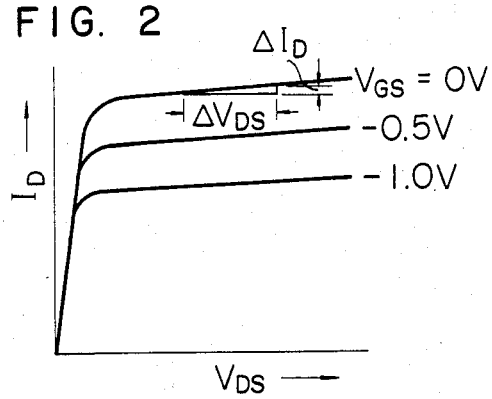
FIG. 2 shows a characteristic of the junction type field effect transistor used in the circuit of FIG. 1.
Figure 3:
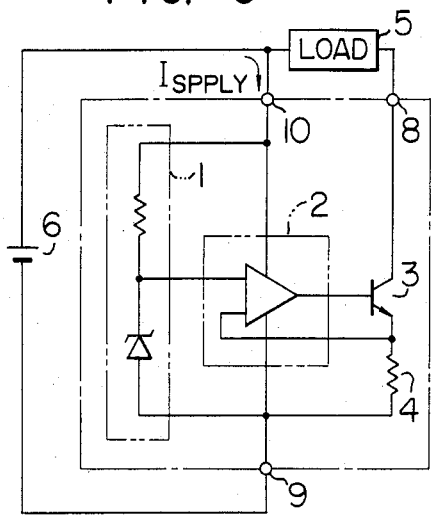
FIG. 3 is a block diagram of a prior art three-terminal current regulator.
Figure 4:
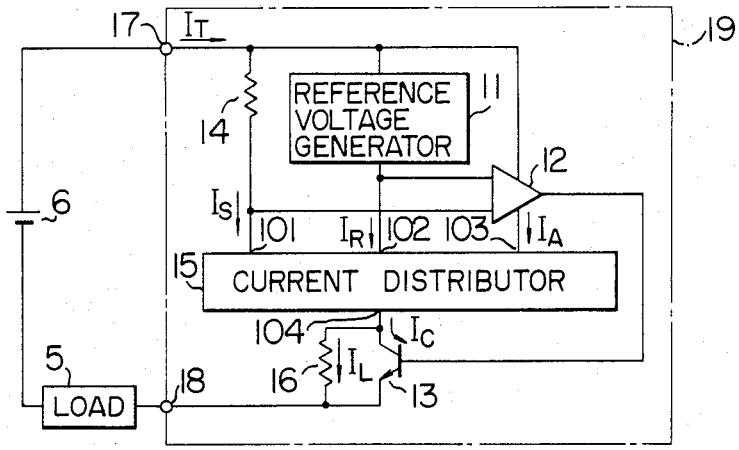
FIG. 4 is a block diagram of one embodiment of the present invention.

Referring to FIG. 4, one embodiment of the present invention is described, in which the like elements to those shown in FIG. 3 are designated by the like numerals and they are not explained here.

A sensing resistor 14 for sensing a current flowing therethrough in accordance with an output voltage of a D.C. power supply 6 is electrically connected between a terminal 17 and an input terminal 101 of a current ditributor 15. A reference voltage generator 11 is electrically connected between the terminal 17 and an input terminal 102 of the current distributor 15, and an error amplifier 12 for generating an error signal is electrically connected between the terminal 17 and an input terminal 103 of the current distributor 15. An output terminal 104 of the current ditributor 15 is connected to a terminal 18 through a current controller 13 which controls the current flowing through the sensing resistor 14. One input terminal of the error amplifier 2 is connected to an output of the reference voltage generator 11 and the other input terminal of the error amplifier 12 is connected to the sensing resistor 14 to receive a voltage drop signal developed across the sensing resistor 14, and an output terminal of the error amplifier 12 is electrically connected to an input terminal of the current controller 13. A starting resistor 16 is connected in parallel to the current controller 13. The terminal 17 is connected to a positive output terminal of the D.C. power supply 6 and the terminal 18 is connected to a negative output terminal of the D.C. power supply 6 through a load 5.

The current distributor 15 controls a current $I_R$ flowing in the reference voltage generator 11 and a current $I_A$ flowing in the error amplifier 12 such that the currents $I_R$ and $I_A$ are proportional to the current $I_S$ flowing through the sensing resistor 14. Namely, $$I_R = K_R \times I_S \quad (1)$$

$$I_A = K_A \times I_S \quad (2)$$

where $K_R$ and $K_A$ are proportional constants. Thus, a total current $I_T$ is given by $$I_T = I_S + I_R + I_A \quad (3)$$

The current $I_S$ is controlled by the error amplifier 12 and is given by $$I_S \times R_S = V_R \quad (4)$$

where $V_R$ is the reference voltage generated by the reference voltage generator 11 and $R_S$ is a resistance of the sensing resistor 14.

From the equations (1) to (4), we get $$I_T = I_S(1 + K_R + K_A) \quad (5)$$

$$= \frac{V_R}{R_S}(1 + K_R + K_A)$$

Since $V_R$, $K_A$, $K_R$ and $R_S$ are constant, the total current $I_T$ is constant and there is no unregulated current path. Thus, a two-terminal current regulator which is not affected by the power supply voltage is provided.

At the start of the circuit, a current flowing through the starting resistor 16 is distributed by the current distributor 15 so that failure of start is prevented. The current $I_L$ flowing through the starting resistor 16 is determined such that $I_L < I_T$.

Figure 5:
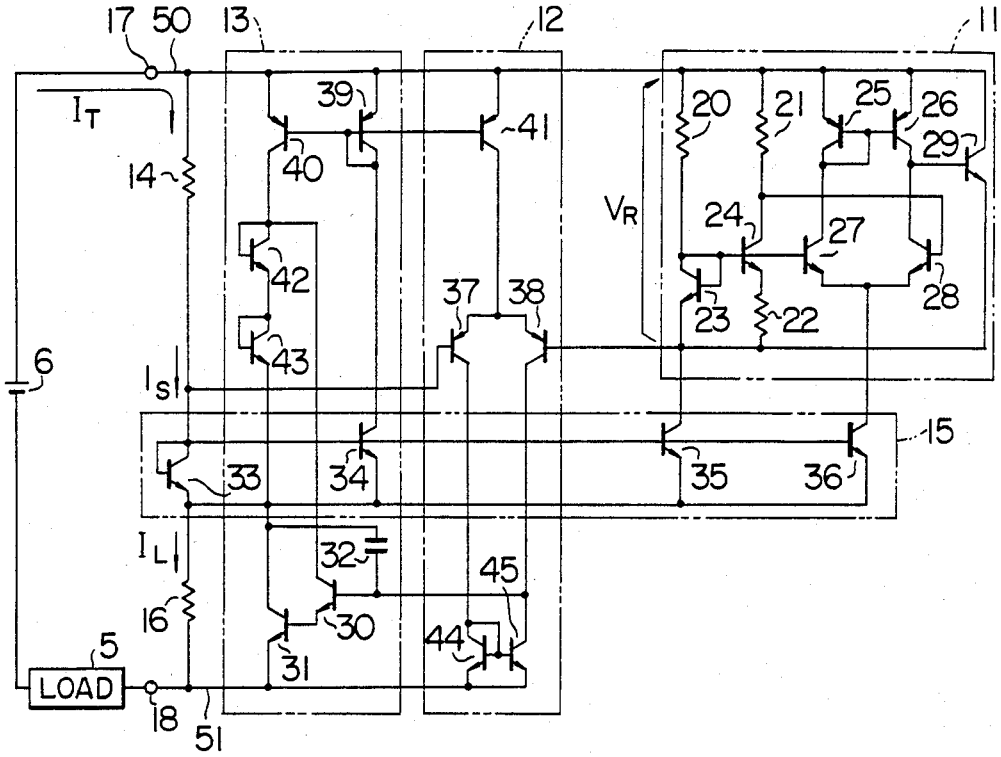
FIG. 5 is a specific circuit diagram of another embodiment of the present invention.

FIG. 5 is a circuit diagram of a preferred embodiment of the circuit configuration shown in FIG. 4. One end of the sensing resistor 14 which develops a voltage thereacross representative of a current flowing therethrough in accordance with the voltage of the D.C. power supply 6 is connected to a positive common bus line 50 which is connected to the terminal 17, and the other end of the sensing resistor 14 is connected to a collector of a transistor 33 of the current distributor 15. An emitter of the transistor 33 is connected to one end of the starting resistor 16 and a collector of a transistor 31 of the current controller 13, and the other end of the starting resistor 16 and an emitter of the transistor 31 are connected to a negative common bus line 51 which is connected to the terminal 18.

A block 11 shows the reference voltage generator in which transistors 27 and 28 form a differential amplifier. Emitters of the transistors 27 and 28 are connected together and connected to a collector of a transistor 36. An emitter of a transistor 25 is connected to the positive bus line 50 and a collector thereof is connected to a collector of the transistor 27. A base and an emitter of the transistor 25 are connected together and connected to a base of a transistor 26. An emitter of the transistor 26 is connected to the positive bus line 50 and a collector thereof is connected to a collector of the transistor 28. A collector of a transistor 29 is connected to the positive bus line 50 and a base thereof is connectd to the collector of the transistor 28, and an emitter of the transistor 29 is connected to an emitter of a transistor 23. A collector of the transistor 23 is connected to the positive bus line 50 through a resistor 20 and a base and the collector thereof are connected together and connected to a base of a transistor 24. A collector of the transistor 24 is connected to the positive bus line 50 through a resistor 21 and an emitter thereof is connected to an emitter of the transistor 23 through a resistor 22. Bases of the transistors 27 and 28 are connected to the resistors 20 and 21, respectively. A block 12 shows the error amplifier for generating the error signal based on the differential voltage between the voltages across the resistors 20 and 21, in which transistors 37 and 38 form the differential amplifier. Emitters of the transistors 37 and 38 are connected together and connected to a collector of the transistor 41. A collector of the transistor 37 is connected to a collector of a transistor 44. An emitter of the transistor 44 is connected to the negative bus line 51 and the collector and a base thereof are connected together and connected to a base of a transistor 45. A collector of the transistor 45 is connected to a collector of the transistor 38 and an emitter thereof is connected to the negative bus line 51. 'A base of the transistor 38 is connected to the emitter of the transistor 23 of the reference voltage generator 11 and a bsae of the transistor 37 is connected to the sensing resistor 14. An emitter of the transistor 41 is connected to the positive bus line 50 and a base thereof is connected to a base of a transistor 39 of the current controller 13. In the current controller 13, the base and a collector of the transistor 39 are connected together and connected to a collector of a transistor 34 of the current distributor 15. The base of the transistor 39 is connected to a base of a transistor 40. An emitter of the transistor 40 is connected to the positive bus line 50 and a collector thereof is connected to a collector of a transistor 42. A base and the collector of the transistor 42 are connected together and an emitter thereof is connected to a collector of a transistor 43. The collector and a base of the transistor 43 are connected together and an emitter thereof is connected to a collector of a transistor 31 of the current controller 13. The collector of the transistor 40 is also connected to a collector of a transistor 30 of the current controller 13. In the current controller 13, an emitter of the transistor 30 is connected to a base of the transistor 31 and a base of the transistor 30 is connected to a collector of the transistor 45 of the error amplifier 12. A capacitor 32 is connected between the base of the transistor 30 and the collector of the transistor 31. In the current distributor 15, the base and the collector of the transistor 33 are connected together and bases of the transistors 33, 34, 35 and 36 are connected together and emitters thereof are also connected together.

The terminal 17 is connected to the positive output terminal of the D.C. power supply 6 and the terminal 18 is connected to the negative output terminal of the D.C. power supply 6 through the load 5.

The operations of the respective units are now explained in detail.

The reference voltage generator 11 has a circuit configuration suitable for integrated circuit. The circuit of the reference voltage regulator 11 is a known constant voltage circuit in which an output voltage $V_R$ thereof is selected to be equal to N times of a silicon bond gap of approximately 1.2 volts, where N is an integer so that a temperature coefficient of $V_R$ is zero. In the present embodiment, the output voltage $V_R$ is selected to 1.2 volts to ensure a stable operation even with a lower power supply voltage.

The output voltage $V_R$ of the reference voltage generator 11 is given by, $$V_R = V_{BE23} + \frac{R_{21}}{R_{22}} \cdot V_{BE} \tag{6}$$

where $V_{BE23}$ represents the base-emitter voltage of the transistor 23, $V_{BE}$ represents the differential voltage between the base-emitter voltages of the transistor 23 and 24, $R_{21}$ and $R_{22}$ are the resistances of the resistors 21 and 22, respectively. $V_{BE}$ varies depending upon emitter areas of the transistors 23 and 24, collector currents of the transistors 23 and 24 and the absolute temperature T. However, under the condition of the equal emitter areas, $V_{BE}$ depends upon the collector currents and the absolute temperature T. By the way, the transistors 27 and 28 constitute the differential amplifier and it compares the voltage across the resistor 20 generated by the collector current of the transistor 23 and the voltage across the resistor 21 generated by the collector current of the transistor 24 and drive the transistor 29 in accordance with the differential voltage to control the current flowing in the collector of the transistor 23. As a result, the voltage across the resistor 20 and the one across the resistor 21 are equalized and therefore, the ratio of the collector current of the transistor 23 to that of the transistor 24 is determined by the ratio of the resistance of the resistor 21 to that of the resistor 20 and is a constant. Therefore, $V_{BE}$ depends soley upon the absolute temperature T, or more specifically, varies in proportion to the absolute value T. As is apparent from the equation (6), the temperature coefficient of the base-emitter voltage of the transistor 23 can be cancelled by determining the ratios of the resistance of the resistor 21 to that of the resistor 22 and the resistance of the resistor 21 to that of 20, appropriately, thereby to produce a constant output voltage with zero temperature coefficient.

The current flowing in the differential amplifier constructed by the transistors 27 and 28 and the sum current of the emitter current of the transistor 23, the current flowing through the resistor 22 and the emitter current of the transistor 29 flow into the collectors of the corresponding transistors 36 and 35 of the current distributor 15 connected in series thereto. In the error amplifier 12, the transistors 37 and 38 form the differential amplifier which compares the voltage drop $I_S \times R_{14}$ (where $R_{14}$ is the resistance of the sensing resistor 14) developed by the current $I_S$ flowing through the sensing resistor 14 with the constant output voltage $V_R$ of the reference voltage generator 11 and generates a signal to drive the base of the transistor 30 of the current controller 13 on the basis of the resulting error voltage. The transistor 41 and the transistor 39 of the current controller 13 form a current mirror circuit which supplies a current proportional to the collector current of the transistor 34 of the current ditributor 15 to the differential amplifier constructed by the transistors 37 and 38. A portion of the current is supplied from the collector of the transistor 45 to the base of the transistor 30 of the current controller 13 to drive the transistor 30 and the remaining poriton of the current is returned to the negative bus line 51 from the emitters of the transistors 44 and 45 through the load 5. The transistors 30 and 31 of the current controller 13 are connected in Durlington configuration and the transistor 31 controls the current flowing through the sensing resistor 14 by the output signal from the error amplifier 12. In this manner, the voltage drop across the sensing resistor 14 is equalized to the constant output voltage $V_R$ of the reference voltage generator 11. The capacitor 32 serves to prevent oscillation. Since the transistor 39 of the current controller 13 is connected in series with the transistor 34 of the current distributor 15, the collector current or the emitter current thereof is equal to the collector current of the transistor 34. The transistors 39 and 40 form a current mirror circuit. The transistor 40 also forms the current mirror circuit together with the transistor 41 of the error amplifier 2, as described before. The collector of the transistor 40 is connected directly to the collector of the transistor 30 in the first stage of the Durlington circuit and to the collector of the transistor 31 in the last stage of the Durlington circuit through the diode-connected two serial-stages of transistors 42 and 43 so that a potential difference corresponding to two diodes is present between the collectors of the Durlington circuit transistors 31 and 32. The collector current of the transistor 30 is supplied from the collector current of the transistor 40 and a difference therebetween, that is, a difference between the collector current of the transistor 30 of the current controller 13 and the collector current of the transistor 40 is bypassed to the transistor 31 through the transistors 42 and 43. Stated in another way, the sum of the current flowing in the transistor 42 or 43 and the current flowing in the transistor 30, that is, the collector current of the transistor 40 is proportional to the collector current of the transistor 34 which flows through the transistor 39 of the current mirror circuit.

The starting resistor 16 is connected between the collector and the emitter of the transistor 31.

The current distributor 15 includes the transistors 33 to 36 having their bases and emitters connected together, respectively, to form a current mirror circuit which drains the currents proportional to the emitter areas of the transistors 33 to 36, respectively. The current $I_S$ flowing through the sensing resistor 14 flows into the transistor 33 so that the collector currents of the transistors 34 to 36 are proportional to the current $I_S$.

As is apparent from the above description, the transistors 39, 40 and 41 also form the current mirror type current distributor. Thus, the currents proportional to the emitter or collector current of the transistor 39 flow through the transistors 40 and 41, and since the transistor 39 is connected in series to the transistor 34, the current in the transistor 39 is also proportional to the current flowing through the sensing resistor 14. As a result, the currents in the transistors 40 and 41 are also proportional to the current flowing through the sensing resistor 14.

If the direct connection to the current distributor is not allowed by the circuit configuration, a required number of additional second current distributors can be provided to increase a freedom of circuit design. In connection with the second current distributors, the current distributor 15 directly connected to the sensing resistor 14 is referred to as a first current distributor.

As described above, the currents required to operate the reference voltage generator 11, the error amplifier 12 and the current controller 13 are supplied from the D.C. power supply 6 and proportional to the current $I_S$ flowing through the sensing resistor 14.

In a steady state of the operation, the currents of the circuits are controlled in the following manner.

The difference between the constant reference voltage $V_R$ generated by the reference voltage generator 11 and the voltage drop across the sensing resistor 14 is detected by the error amplifier 12, which controls the current controller 13 to render the difference to zero. Accordingly, the equation (4) described above is met. The total current $I_T$ is given by $$I_T=I_{33}+I_{34}+I_{35}+I_{36}+I_{43}+I_{30}+I_{37}+I_{38} \quad (7)$$

where $I_{33}$–$I_{36}$, $I_{43}$, $I_{30}$, $I_{37}$ and $I_{38}$ are the collector currents of the transistors 33–36, 43, 30, 37 and 38, respectively, and $$I_{43}+I_{33}=I_{40} \quad (8)$$

$$I_{37}+I_{38}=I_{41} \quad (9)$$

where $I_{43}$ and $I_{41}$ are collector currents of the transistors 43 and 41, respectively.

Since the currents $I_{43}$ and $I_{41}$ are proportional to $I_{34}$ (collector current of the transistor 34) by the current mirror effect of the transistors 43, 39 and 41, $$I_{43}=K_1\times I_{34} \quad (10)$$

$$I_{41}=K_2\times I_{34} \quad (11)$$

where $K_1$ and $K_2$ are proportional constants. Accordingly, the equation (7) is rewritten as $$I_T=I_{33}+I_{34}(1+K_1+K_2)+I_{35}+I_{36} \quad (12)$$

Thus, the total current $I_T$ is determined by the current distributor 15.

Since $I_{34}$–$I_{36}$ are determined by the collector current ($=I_S$) of the transistor 33, the total current $I_T$ is kept constant by controlling $I_S$ to the constant level. Accordingly, a high precision constant current characteristic is attained.

When the power is turned on, a voltage close to the voltage $V_S$ of the D.C. power supply 6 is applied to the starting resistor 16 and the current $I_L=I_T=V_S/R_{16}$ (where $R_{16}$ is the resistance of the starting resistor 16) flows therethrough and the currents proportional to $I_T$ flow through the collectors of the transistors 33–36. Thus, the voltages of the respective circuits rise and immediately go into the steady state. Accordingly, the failure of start is prevented.

Since the starting resistor 16 is connected in parallel to the current controller 13, even if the current controller 13 is in off state when the circuit is started, the currents are distributed by the current distributor 15 in proportion to the current flowing through the starting resistor 16. As a result, the circuits are activated without losing the balance of the currents. As the circuits start their operations, the current flowing through the starting resistor 16 and the sum current of the current controller 13 are redistributed to the other circuits by the current distributor 15 so that the start operation is assured. This is attained because the current distributor 15 is constructed as the current mirror circuit which can maintain the current distribution ratio even for the currents which are two or three order lower than the steady state currents. A condition required to assure the starting is that the current first flowing through the starting resistor 16 is substantially proportionally distributed and the current controller 13 is activated. It is not necessary that the current is distributed at a strict distribution ratio at the time of start.

Figure 6:
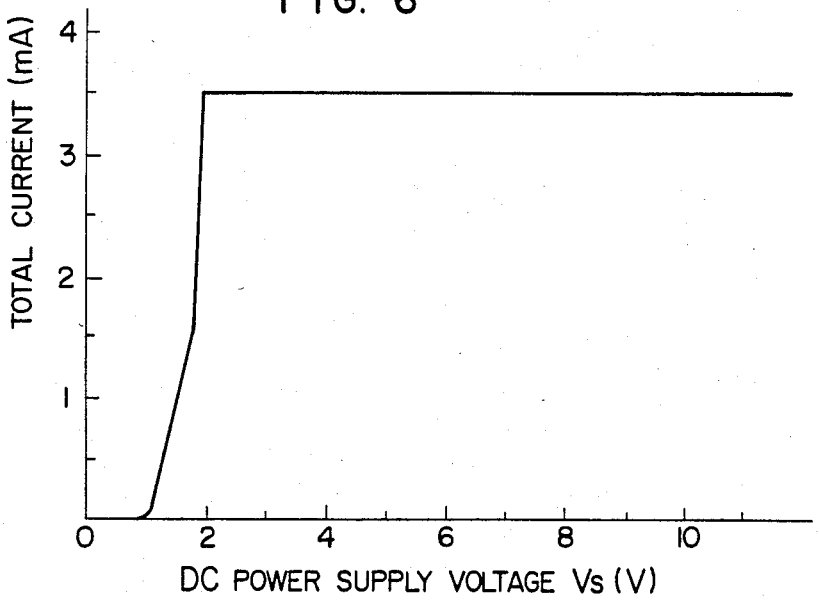
FIG. 6 shows an output characteristic of the two-terminal current regulator of the present invention shown in FIG. 5.

The circuit operates even with a low power supply voltage. The reference voltage $V_R$ generated by the reference voltage generator 11 is selected to the low voltage of approximately 1.2 volts and the voltages across the resistors 20 and 21 are controlled by the amplifier comprising the transistors 23–29 so that those voltages are equalized, and the currents are supplied from the current drain of the current distributor 15. The reference voltage generator 11 is constructed as the differential amplifier, and in the current controller 13, the collector of the transistor 30 and the collector of the transistor 31 are not connected in common and the voltage which is higher by two transistor forward voltages is supplied by the diode-connected transistors 42 and 43. As a result, a good constant current characteristic is attained with a low power supply voltage of approximately 2 volts, as shown in FIG. 6. A voltage coefficient of the total current $I_T$ is less than 20–30 ppm/V.

Most of the circuit components are transistors as shown in FIG. 5 and only the sensing resistor 14 requires an absolute resistance. Accordingly, the circuit is suitable to be implemented by an integrated circuit structure.

If it is allowed to accept less strict constant current characteristic to the temperature variation, the reference voltage generator 11 may be substituted by a zener diode. In this case, since a current flowing through the zener diode is substantially stabilized, a good constant current characteristic to the power supply voltage variation is attained and substantial reduction of the parts count used is attained.

As described hereinabove, according to the present embodiment, the ratio of the currents flowing through all of the current paths is determined by the curent distributor 15. Thus, by controlling the circuit such that the voltage drop across the sensing resistor 14 is kept constant, the high precision constant current characteristic is attained. Since the starting resistor 16 is connected in parallel to the current controller 13, the failure of start is prevented. The constant current characteristic is attained even with the low power supply voltage.

Because of the two-terminal configuration, the circuit can be simply connected in series to the load to be driven by the constant current and the position of the load is not restricted, as opposed to the three-terminal current regulator.

The starting resistor 16 may be substituted by a field effect transistor to attain the same effect.

As described above, according to the present invention, the high precision constant current characteristic which is not affected by the power supply voltage and the temperature variation is attained. The constant current characteristic is attained even with the low power supply voltage, and because of the two-terminal configuration, the current regulator of the present invention can be simply connected in series to the load.

I claim:

1. A two-terminal current regulator comprising:

first and second terminals, one being adapted to be connected to one terminal of a load having the other end thereof connected to one polarity output terminal of non-regulated D.C. power supply, and the other being adapted to be connected to the other polarity output terminal of said D.C. power supply;

detection means arranged to be powered by said D.C. power supply through said first and second terminals for producing a voltage representative of a current flowing in accordance with an output voltage of said D.C. power supply;

reference voltage generating means arranged to be powered by said D.C. power supply through said first and second terminals for generating a reference voltage of a predetermined constant level independently of the output voltage of said D.C. power supply;

error signal producing means arranged to be powered by said D.C. power supply through said first and second terminals for comparing said voltage produced by said detection means with said reference voltage to produce an error signal representative of a difference therebetween;

means responsive to said error signal for controlling the current flowing in said detection means such that said voltage produced by said detection means is maintained at a constant level; and current distribution means connected to said detection means, said reference voltage generating means and said error signal producing means for rendering the currents flowing in said reference voltage generating means and said error signal producing means to be constant ratios to the current flowing in said detection means.

2. A two-terminal current regulator according to claim 1 wherein said current distribution means includes first current distributor for rendering the current flowing in said reference voltage generating means to be a constant ratio to the current flowing in said detection means and second current distribution means for rendering the current flowing in said error signal producing means to be a constant ratio to the current flowing in said detection means.

3. A two-terminal current regulator according to claim 2 wherein said first current distribution means includes a transistor connected in series with said detection means and having a collector and a base thereof connected together and a plurality of transistors having bases thereof connected together and emitters thereof connected together, respectively, in parallel, at least one of said plurality of transistors being connected in series with said reference voltage generating means and one of said plurality of transistors being connected in series with said second current ditribution means, and said second current distribution means includes a transistor connected in series with said one of the plurality of transistors of said first current distribution means and having a collector and a base thereof connected together and a plurality of transistors having bases thereof connected together and emitters thereof connected together, respectively, and said plurality of transistors connected in parallel with said transistor of said second current distribution means, at least one of said plurality of transistors of said second current distribution means being connected in series with said error signal producing means.

4. A two-terminal current regulator according to claim 1 further comprising starting means connected in parallel to said control means.

5. A two-terminal current regulator according to claim 4 wherein said starting means includes a resistor.

6. A two-terminal current regulator according to claim 5 wherein said starting means includes a field effect transistor serving as a resistor.

7. A two-terminal current regulator according to claim 1 wherein said reference voltage generating means includes a zener diode.

8. A two-terminal current regulator comprising:

a first terminal adapted to be connected to one polarity output terminal of a non-regulated D.C. power supply;

a second terminal adapted to be connected to the other polarity output terminal of said D.C. power supply through a load connected in series with said D.C. power supply;

a sensing resistor of a predetermined resistance connected between said first terminal and said second terminal for producing a voltage representative of a current flowing therethrough from said D.C. power supply through said load, in accordance with a voltage of said D.C. power supply;

reference voltage generating means adapted to be powered by said D.C. power supply through said first and second terminals for generating a reference voltage of a predetermined constant voltage level independently of the voltage of said D.C. power supply;

error amplifier means adapted to be powered by said D.C. power supply through said first and second terminals and having one input terminal thereof connected to said sensing resistor and the other input terminal thereof connected to said reference voltage generating means for comparing the voltage developed across said sensing resistor with the output voltage of said reference voltage generating means to produce an error signal representative of a difference between said voltages;

current control means adapted to be powered by said D.C. power supply through said first and second terminals and connected in series with said sensing resistor and responsive to said error signal for controlling the current flowing in said sensing resistor such that the voltage developed across said sensing resistor is equalized to the output voltage of said reference voltage generating means; and current distribution means connected to current paths of the currents supplied to operate said sensing resistor, said reference voltage generating means, said error amplifier means and said current control means for rendering the operation currents of said reference voltage generating means, said error amplifier means and said current control means to be constant ratios to the current of said sensing resistor.

9. A two-terminal current regulator according to claim 1 wherein said current distribution means includes first current distributor for rendering the current flowing in said reference voltage generating means to be a constant ratio to the current flowing in said sensing resistor and second current distribution means for rendering the currents flowing in said error amplifier means and said current control means to be a constant ratio to the current flowing in said sensing resistor.

10. A two-terminal current regulator according to claim 9 wherein said first current distribution means includes a transistor connected in series with said sensing resistor and having a collector and a base thereof connected together and a plurality of transistors having bases thereof connected together and emitters thereof connected together, respectively, in parallel, at least one of said plurality of transistors being connected in series with said reference voltage generating means and one of said plurality of transistors being connected in series with said second current ditribution means, and said second current distribution means includes a transistor connected in series with said one of the plurality of transistors of said first current distribution means and having a collector and a base thereof connected together and a plurality of transistors having bases thereof connected together and emitters thereof connected together, respectively, said plurality of transistors connected in parallel with said transistor of said second current distribution means, at least one of said plurality of transistors of said second current distribution means being connected said error amplifier means, and another at least one of said plurality of transistors being connected to said current control means.

11. A two-terminal current regulator according to claim 8 further comprising starting means connected in parallel to said current control means.

12. A two-terminal current regulator according to claim 11 wherein said starting means includes a resistor.

13. A two-terminal current regulator according to claim 12 wherein said starting means includes a field effect transistor serving as a resistor.

14. A two-terminal current regulator according to claim 8 wherein said reference voltage generating means includes a zener diode.

* * * * *